US007468709B2

(12) United States Patent
Niemi et al.

(10) Patent No.: US 7,468,709 B2
(45) Date of Patent: Dec. 23, 2008

(54) METHOD FOR MOUNTING A RADIATOR IN A RADIO DEVICE AND A RADIO DEVICE

(75) Inventors: Matti Niemi, Arkkukari (FI); Kimmo Antila, Kiviniemi (FI); Ilkka Niemelä, Tampere (FI)

(73) Assignee: Pulse Finland Oy, Kempele (FI)

( * ) Notice: Subject to any disclaimer, the term of this patent is extended or adjusted under 35 U.S.C. 154(b) by 0 days.

(21) Appl. No.: 11/373,048

(22) Filed: Mar. 10, 2006

(65) Prior Publication Data

US 2006/0197712 A1 Sep. 7, 2006

Related U.S. Application Data

(63) Continuation of application No. PCT/FI2004/000507, filed on Sep. 2, 2004.

(30) Foreign Application Priority Data

Sep. 11, 2003 (FI) ..... 20031298

(51) Int. Cl.
*H01Q 1/40* (2006.01)
*H01Q 1/24* (2006.01)

(52) U.S. Cl. ..... 343/873; 343/702

(58) Field of Classification Search ..... 343/702, 343/873, 872

See application file for complete search history.

(56) References Cited

U.S. PATENT DOCUMENTS 6,061,036 A * 5/2000 MacDonald et al. ..... 343/873
6,222,497 B1 * 4/2001 Hu et al. ..... 343/846

(Continued)

FOREIGN PATENT DOCUMENTS

DE 100 21 880 A1 11/2001

(Continued)

OTHER PUBLICATIONS

Ed Schoepke, "Chip Antenna Layout Considerations for 802.11 Applications", Johanson Technology, Jan. 2006, pp. 1-7, http://www.johansontechnology.com/technicalnotes/ant/JTI_Antenna-Mounting_2006-11.pdf.

*Primary Examiner*—Michael C Wimer
(74) *Attorney, Agent, or Firm*—Darby & Darby

(57) ABSTRACT

The invention relates to a method for mounting a radiating antenna element used especially in the manufacture of small-sized radio devices and a radio device with a radiator mounted by the method. A thin thermoplastic plate coated with a metal foil is used in the manufacture of the antenna. A radiator pattern is formed in the metal foil. The antenna component obtained is placed (401) on the surface of some plastic part of the radio device, preferably on the inner surface of the thermoplastic cover of the radio device. The plastic layer of the antenna component becomes positioned against said plastic part, and the component is fastened (402, 403) by fusing together the mating plastic materials, which are against each other. In the complete antenna, the radiator is electrically connected to the other parts of the radio device by means of contacts. The radiator of the antenna of the radio device becomes fastened to the radio device very firmly, which has a stabilizing effect on the electric properties of the antenna. In addition, the antenna can be formed using relatively cheap raw materials.

1 Claim, 4 Drawing Sheets

U.S. PATENT DOCUMENTS

| | | | | |
|---|---|---|---|---|
| 6,342,858 | B1 * | 1/2002 | Dakeya et al. | 343/702 |
| 2002/0145567 | A1 | 10/2002 | Spiegel et al. | |
| 2003/0122726 | A1 | 7/2003 | Abbasi | |

FOREIGN PATENT DOCUMENTS

| | | | |
|---|---|---|---|
| EP | 1 187 255 | A3 | 3/2002 |
| JP | 11-168316 | A | 6/1999 |
| JP | 2001-94335 | A | 4/2001 |
| JP | 2003-78322 | A | 3/2003 |
| WO | WO-03/075398 | A1 | 9/2003 |

* cited by examiner

METHOD FOR MOUNTING A RADIATOR IN A RADIO DEVICE AND A RADIO DEVICE

CROSS-REFERENCE TO RELATED APPLICATION

The present application is a continuation of International Patent Application Serial No. PCT/FI2004/000507, filed Sep. 2, 2004, published in English, which claims priority to Finnish Patent Application No. 20031298, filed Sep. 11, 2003, both of which are hereby expressly incorporated by reference in their entireties.

TECHNICAL FIELD

The invention relates to a method for mounting a radiating antenna element, i.e. a radiator, used especially in the manufacture of small-sized radio devices. The invention also relates to a radio device which has a radiator manufactured by the method.

BACKGROUND OF THE INVENTION

The invention is used to form an antenna that does not change the appearance of the radio device. In small-sized radio devices, such as mobile stations, such antennas usually have a planar structure: The antenna comprises a planar radiating element and a ground plane parallel with it. The electric properties of the planar antenna, such as the bandwidth and antenna gain, depend on the distance between said planes, among other things. When the mobile stations become smaller, even with regard to thickness, the distance mentioned above is inevitably reduced, whereby the electric properties deteriorate.

The internal space of a radio device can be used more efficiently by making the radiating element of the antenna such that it runs along the inner surface of the cover of the device. FIG. 1 shows an example of such an element known from the application FI 20012219. The conductive antenna element 110 is curved at its three edges so that the element has the same shape as the end part of the rear cover of the radio device. In the complete product, the element 110 is located against the rear cover. The element also comprises the antenna feed conductor FC and the short-circuit conductor SC that begin from its edge. The element 110 is an extruded piece in which a slot 117 has been machined before fastening so that the element is divided into two branches of different lengths, B1 and B2, as viewed from the short-circuit point. Therefore, the complete antenna is a dual band antenna.

Using a foil-like radiator located on the surface of the shell of the radio device is also known from before. FIG. 2 shows such a case. It is a simplified cross-section of a radio device equipped with an internal antenna, showing the cover 220 and main circuit board 201 of the radio device. A flexible antenna circuit board 210 of almost the width of the inner space of the radio device has been fastened to the inner surface of the cover by glueing. The radiating element 211 is a conductive foil belonging to the antenna circuit board and being located against the cover 220.

In the invention it is utilized thermoplastic material. Thermoplastic materials are suitable for moulding to a desired shape in a certain temperature. Their use in the industry is known as such. The use of thermoplastic material also in the manufacture of antennas is known from the application publication EP 0569016. It is in question a radar antenna, in which a number of components have been made by coating thermoplastic pieces with copper. After this, the components have been glued in place.

SUMMARY OF THE INVENTION

It is an objective of the invention to implement in a new manner an antenna that does not change the appearance of a radio device. The method according to the invention is characterized in what is set forth in the independent claim 1. The radio device according to the invention is characterized in what is set forth in the independent claim 5. Some preferred embodiments of the invention are set forth in the other claims.

The basic idea of the invention is the following: A thin thermoplastic plate coated with a metal foil is used in the manufacture of the antenna. A radiator pattern is formed in the metal foil, and the plastic plate supports the radiator so that the shape of this pattern is retained. The antenna component obtained is placed on the surface of some plastic part of the radio device, preferably on the inner surface of the thermoplastic cover of the radio device. The plastic layer of the antenna component becomes positioned against said plastic part, and the component is fastened by fusing together the plastic materials, which are against each other. In the complete antenna, the radiator is electrically connected to the other parts of the radio device by means of contacts.

The invention has an advantage that the radiator of the antenna of the radio device becomes fastened to the radio device very firmly, which has a stabilizing effect on the electric properties of the antenna. The invention further has an advantage that the antenna can be formed using relatively cheap raw materials. The antenna has relatively low production costs in other respects, too. Furthermore, the invention has the advantage that it is well suited for manufacturing an antenna that utilizes the inner space of the radio device efficiently.

BRIEF DESCRIPTION OF THE DRAWINGS

In the following, the invention will be described in more detail. Reference will be made to the accompanying drawings, in which.

DETAILED DESCRIPTION OF THE INVENTION

Figure 1:
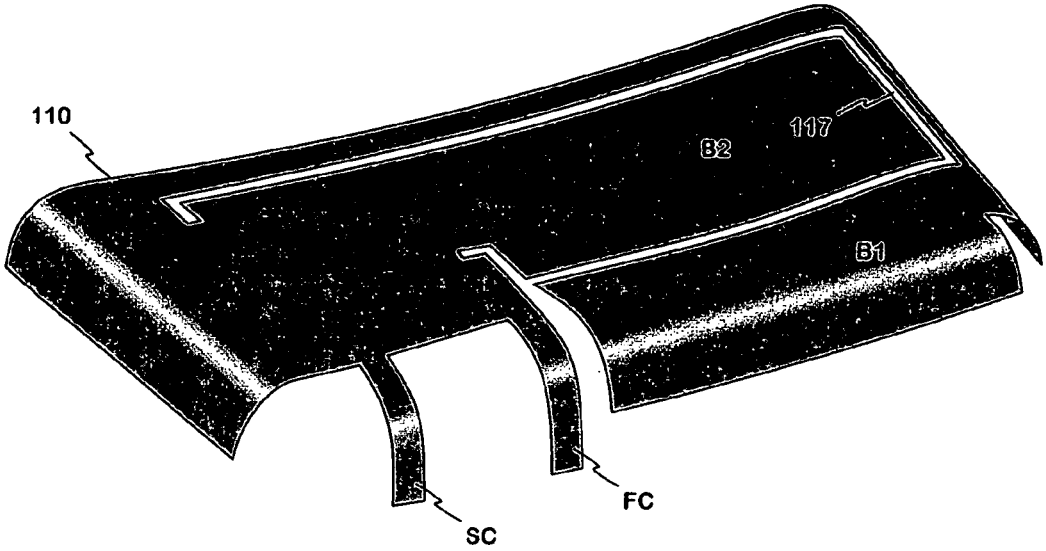
Fig. 1 PRIOR ART
FIG. 1 shows an example of a prior art space-saving antenna element.
Figure 2:
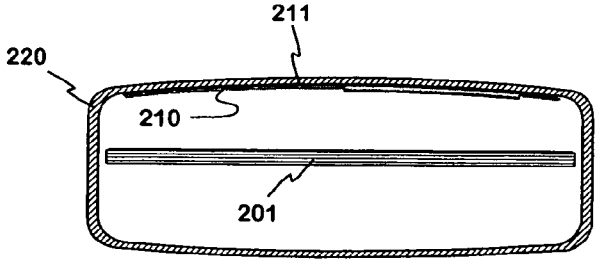
Fig. 2 PRIOR ART
FIG. 2 shows another example of a prior art space-saving antenna element.

FIGS. 1 and 2 were already discussed in connection with the description of the prior art.

Figure 3A:
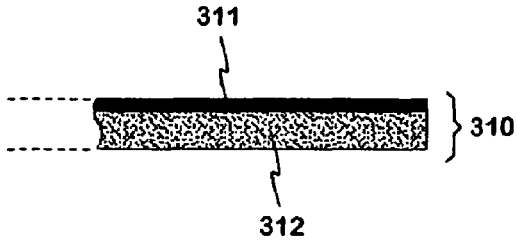
FIGS. 3*a-c* show an example of an antenna component according to the invention and its location.
Figure 3B:
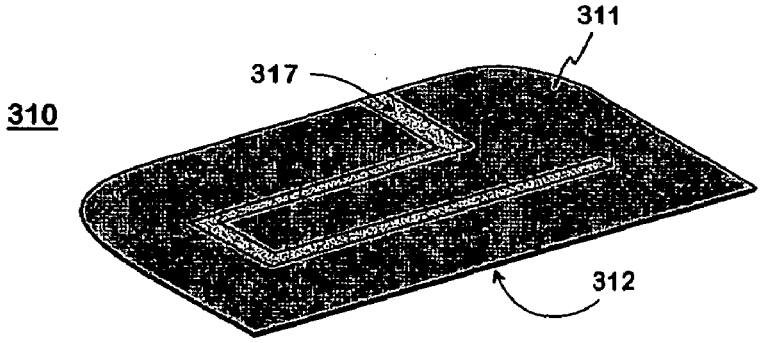
Figure 3C:
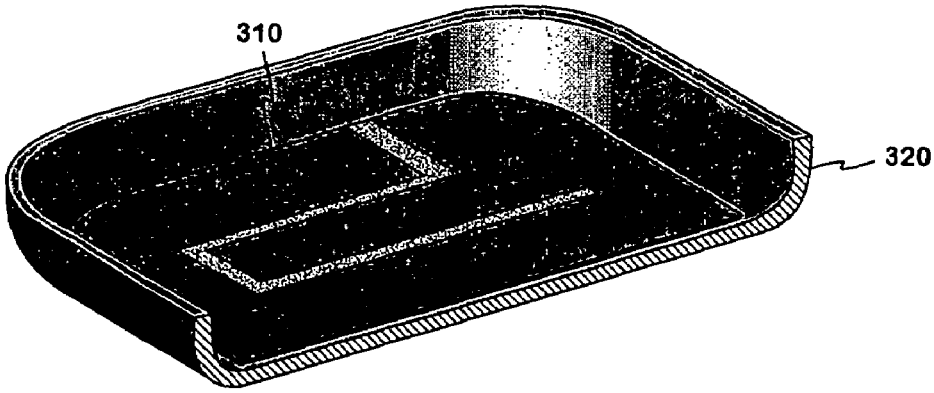

FIGS. 3*a*, 3*b* and 3*c* show an example of an antenna component according to the invention and its location. FIG. 3*a* presents an enlarged cross-section of the antenna component. The antenna component 310 comprises a planar radiator 311 and a layer 312 made of thermoplastic dielectric material. The radiator 311 and the layer 312 are on top of each other and join firmly to each other for the whole of their area. FIG. 3*b* shows the antenna component 310 as a perspective drawing. As viewed from above, it is shaped like a rectangle with two corners rounded to correspond to the shape of the end of a small-sized radio device. In this example, the radiator 311 has a non-conductive slot 317 starting from its edge. The slot is shaped so that the radiator is divided into two branches of different lengths, as viewed from the short-circuit point of the antenna, to be located beside the open end of the slot, on its right side in FIG. 3*b*. Thus the complete antenna becomes a dual-band antenna. In FIG. 3*c* the antenna component 310 is placed in its final position. The drawing shows part of the plastic outer cover 320 of the radio device. The part of the cover in question is, e.g. in the case of a mobile phone, the end of the rear cover of the phone that is on the side of the loudspeaker. The antenna component 310 is against the inner surface of the trough-like rear cover. Its length is almost the same as the width of the inner space of the cover, in which case the antenna component entirely covers the even part of the inner surface at said end of the radio device. The thermoplastic layer of the antenna component is against the plastic cover for the fastening that takes place by fusing.

Figure 4:
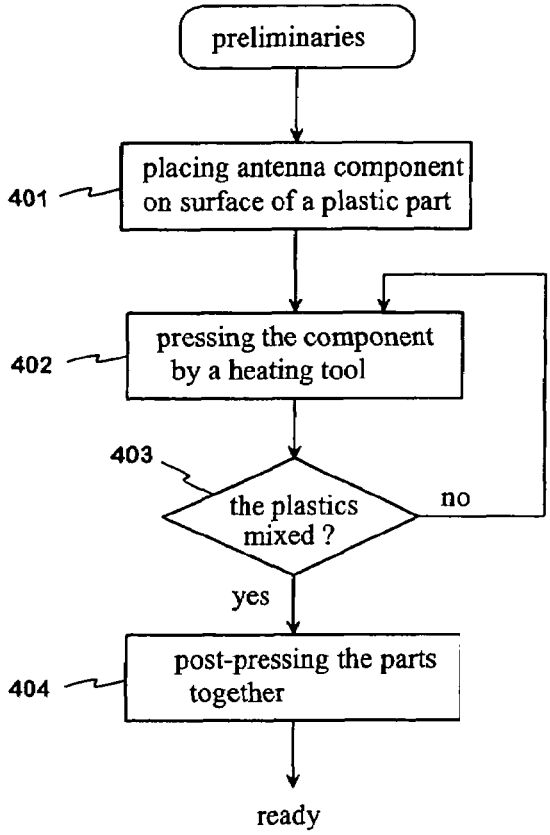
FIG. 4 shows, as a flow chart, an example of a method according to the invention.

FIG. 4 shows an example of a method according to the invention as a flow chart. In the preliminary step, planar antenna components are manufactured from a thermoplastic plastic board, which is coated with a metal foil fastening permanently to the plastic. The plastic board supports the radiator pattern formed in the metal foil so that the shape of the radiator cannot change during mounting. In step 401, the antenna component is placed on the surface of some plastic part of the radio device. In step 402, the antenna component is pressed with a heating tool against the surface, whereby thermal energy is transferred from the tool to the antenna component and through it to the plastic part of the radio device. In step 403, it is waited until the plastic of the antenna component and the plastic of the plastic part have been suitably melted and mixed together by the effect of thermal energy. For this purpose, the plastic material of the plastic part of the radio device is also of the thermoplastic type. After this, the pressing of the antenna component against the plastic part is continued with the unheated tool in accordance with step 404, until the plastic material has cooled and hardened sufficiently. Due to the nature of the process described, the joint created between the radiator and the plastic part of the radio device is strong.

Figure 5:
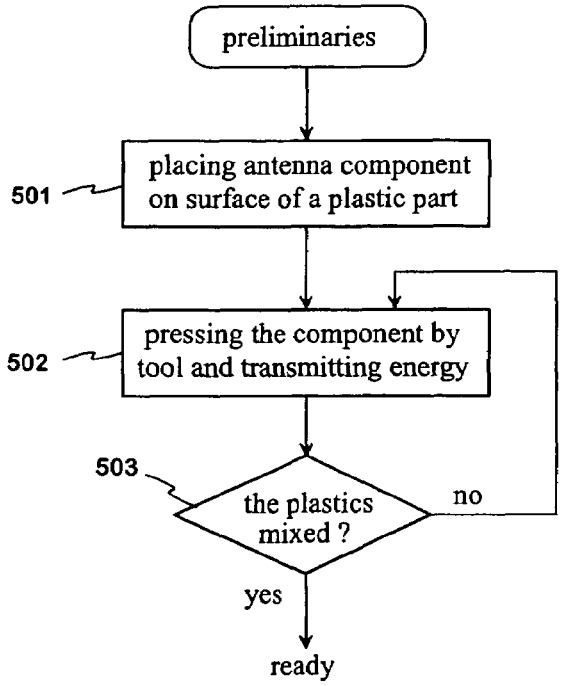
FIG. 5 shows another example of a method according to the invention.

The melting of the plastic materials can also be arranged in other ways than by means of thermal energy brought from outside. FIG. 5 is a flow chart of some other embodiments of the method according to the invention. The preliminaries and the placing of the antenna component (step 501) on the surface of a plastic part of the radio device take place like in FIG. 4. In step 502, the antenna component is pressed against the surface in question with a tool that transmits energy to the antenna component in some form. The energy can be, for example, in ultrasonic vibration or laser-type electromagnetic oscillation. In either case, the energy is converted into heat in thermoplastic materials, causing them to melt together. The names ultrasonic welding and laser welding can be used. In step 503, it is waited until this fusion has taken place. A post-pressing step according to FIG. 4 is not needed in these embodiments. The end result is similar in all embodiments.

Figure 6:
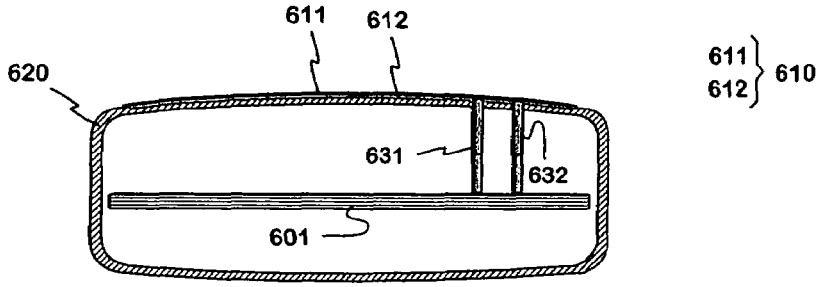
FIG. 6 shows another example of a location of the antenna component according to the invention.

FIG. 6 shows another example of the location of an antenna component according to the invention. The figure shows a simplified cross-section of a radio device, which comprises a cover 620 and a circuit board 601. The antenna component 610, which includes a radiator 611 and a plastic layer 612, is fastened to the outer surface of the cover 620 in accordance with the invention. The thermoplastic layer 612 and the outer part of the cover have thus been melted together. Lastly, a thin dielectric protective foil has been glued on top of the radiator 611. The short-circuit conductor 631 and feed conductor 632 of a PIFA type antenna also has been drawn In FIG. 6.

Figure 7:
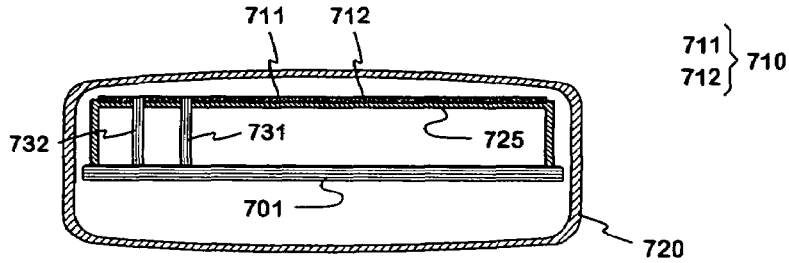
FIG. 7 shows a third example of a location of the antenna component according to the invention.

FIG. 7 shows a third example of the location of an antenna component according to the invention. The figure shows a simplified cross-section of a radio device, which comprises a cover 720, a circuit board 701 and a plastic antenna frame 725 resting on the circuit board. The antenna component 710, which includes a radiator 711 and a plastic layer 712, is fastened to the even upper surface of the frame 725 in accordance with the invention. The thermoplastic plastic layer 712 and the plate-like upper part of the antenna frame have thus been melted together. The short-circuit conductor 731 and feed conductor 732 of a PIFA type antenna also has been drawn In FIG. 7.

Figure 8:
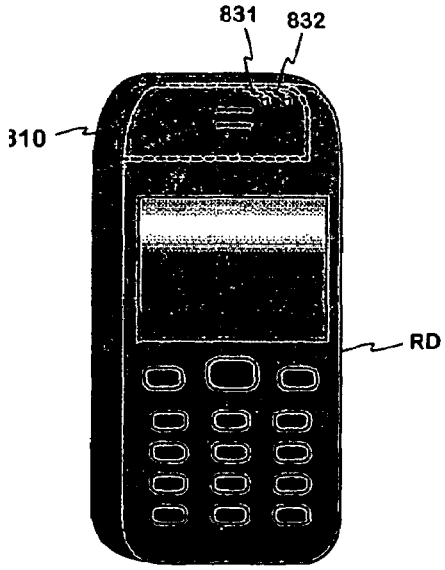
FIG. 8 shows an example of a radio device according to the invention.

FIG. 8 shows an example of a radio device according to the invention. An antenna component 810 including a radiator, drawn with a dashed line, has been melted to the rear cover of the radio device RD that resembles a mobile phone. In addition, the figure presents the short-circuit conductor 831 and feed conductor 832 of the antenna of the radio device, which have been fastened to the radiator by soldering, for example. Alternatively, e.g. pogo pins fastened to the circuit board of the radio device can be used as the short-circuit and feed conductors.

A method and a radio device according to the invention have been described above. As appears from the examples, the place where the antenna component is fastened in the radio device can vary. Naturally, the shape of the antenna component can be selected relatively freely, and the method can also very in its details. The inventive idea can be applied in different ways within the scope defined by the independent claims.

The invention claimed is:

1. A method for mounting a foil-like radiator in a radio device, in which method the radiator together with dielectric material supporting it is fastened to the radio device, wherein said dielectric material is thermoplastic material, and the method comprises steps:

placing an antenna component formed by the radiator and said thermoplastic material on a surface of some plastic part of the radio device, the antenna component being located inside an outer cover of the radio device;

pressing the antenna component with a tool against said surface, and at the same time transmitting energy towards the antenna component to fasten the radiator without an adhesive; and continuing the transmitting of said energy until the thermoplastic material of the antenna component and material of said plastic part have been partly mixed together.

* * * * *